US005300151A

United States Patent [19]

Lowther

[11] Patent Number: 5,300,151

[45] Date of Patent: Apr. 5, 1994

[54] METHOD OF CLEANING A TUBULAR WITH HARDENED LAYER GELATIN PIG

[75] Inventor: Frank E. Lowther, Plano, Tex.

[73] Assignee: Atlantic Richfield Company, Los Angeles, Calif.

[21] Appl. No.: 896,634

[22] Filed: Jun. 10, 1992

[51] Int. Cl.[5] ..... B08B 9/04

[52] U.S. Cl. ..... 134/8; 134/22.11

[58] Field of Search ..... 134/8, 7, 22.11; 15/104.061

[56] References Cited

U.S. PATENT DOCUMENTS

| | | | |
|---|---|---|---|
| 2,744,880 | 5/1956 | Brown | 134/8 |
| 2,906,650 | 9/1959 | Wheaton | 134/8 |
| 3,863,717 | 2/1975 | Cooper | 166/279 |
| 4,003,393 | 1/1977 | Jaggard et al. | 137/15 |
| 4,216,026 | 8/1980 | Scott | 134/4 |
| 4,254,559 | 3/1981 | Purington, Jr. | 34/9 |
| 4,416,703 | 11/1983 | Scott | 134/8 |
| 4,473,408 | 9/1984 | Purington, Jr. | 134/8 |
| 4,537,700 | 8/1985 | Purington, Jr. | 134/8 |
| 4,543,131 | 9/1985 | Purington, Jr. | 134/8 |

OTHER PUBLICATIONS

Kirk-Othmer, Encyclopedia of Chemical Technology, vol. 11, J. Wiley & Sons, N.Y. pp. 711-715, 1986.

The Theory of the Photographic Process, 3rd Edition, The Macmillan Company, N.Y. pp. 45-60, 1980.

"FLAGS" gas-line sediment removed using gel plug technology; Scott et al, Oil and Gas Journal; Oct. 26, 1981, pp. 97-109.

"The Use of Gelly Pig Technology for Removal of Stuck Mechanical Pigs"; D. P. Nesbitt; OTC 6772, 23rd OTC, Houston, Tex. May 6-9, 1991.

*Primary Examiner*—R. Bruce Breneman
*Assistant Examiner*—Saeed Chaudhry
*Attorney, Agent, or Firm*—Drude Faulconer

[57] ABSTRACT

A method and gelatin pig is provided for scraping and cleaning tubulars. The gelled, cleaning pig has a body comprised of gelled technical gelatin which has a hardened outer layer. The pig is molded in a size sufficient for the periphery of the body to contact the interior wall of the tubular to be cleaned. The outer surface of the gelatin is hardened by merely exposing the outer surface of the gelatin to the atmosphere (i.e. air) or by applying a hardener (e.g. aldehyde) to the outer surface. In operation, the gelatin pig is inserted into and passed through the pipeline to scrap and clean same. The pig is bio-degradable which can be accelerated by adding a bio-reactive agent, e.g. yeast, to the gelatin.

10 Claims, No Drawings

METHOD OF CLEANING A TUBULAR WITH HARDENED LAYER GELATIN PIG

DESCRIPTION

1. Technical Field

The present invention relates to the scraping and cleaning of tubulars and in one of its aspects relates to a method wherein a gelled pig is passed through the tubular to scrap and clean the tubular wherein the pig has a body which is formed of common gelatin which, is hardened on its outer surface to form a hardened layer thereon.

2. Background Art

As is known in the art, the interior of most tubulars, e.g. pipelines, should be cleaned after construction and periodically during operation to remove scale and debris to thereby achieve and maintain high flow efficiencies therethrough. For example, in pipelines such as those used for transporting crude oil and/or natural gas, it is common for substantial amounts of sand, rust, weld slag, and other debris to accumulate in the line during construction. Further, these pipelines periodically experience substantial losses in flow efficiencies during their operational lives due to (1) scale buildup on the interior wall of the pipe and/or (2) the accumulation of solid materials (e.g. sand, debris, asphaltenes, etc.) which are deposited in the line from the fluids flowing normally therethrough. As recognized by the art, it is desirable, if not mandatory, to remove this scale and debris from the line at regular maintenance intervals or when a substantial loss in flow efficiency is detected.

There are several known techniques for removing scale and/or debris from such tubulars. These include the use of high velocity, turbulent flow through the pipeline, mechanical scrapers, and/or gelled plugs or pigs to remove the debris from the pipe. While each of these techniques have experienced success, each has some apparent disadvantages. For example, most pipelines simply do not have the pumping capacity required to generate high enough flow velocities to generate the turbulence required to adequately clean the scale and debris out of the pipeline. To so equip most pipelines would be economically infeasible.

Mechanical pigs or scrapers have been widely used for scaping and cleaning pipelines. A typical mechanical scraper is comprised of a solid, piston-like body having wire brushes or abrasive surfaces thereon which physically abrade or "scrap" the scale off the interior of the pipe as the scraper is pushed through the pipe by fluids flowing therethrough. The scale and other debris in the pipe is pushed through the line ahead of the scraper. Unfortunately, this debris is likely to continue to build-up ahead of the scraper until debris bypasses the scraper where it remains in the line. Still further, the debris accumulating ahead and around the scraper may cause the scraper to become stuck in the pipe thereby requiring the line to be cut in order to remove the scraper before flow can be resumed in the line. In addition to the disadvantages set forth above, mechanical scrapers are also costly and time-consuming to use in that expensive and cumbersome "launchers" and "catchers" must be installed in the pipeline to be cleaned to launch and retrieve the mechanical scrapers.

Gelled pigs, comprised of a variety of different compositions, have been use pipelines to remove debris from pipelines. These pigs, sometimes referred as "debris pick-up gelled pigs", are passed through a line to pick-up and entrain debris so it can be carried out of the line with the pig. Unfortunately, however, many of these gels either (1) act much like a mechanical scrapper in that debris, as it builds-up ahead of the pig, may bypass the gelled pig and be left in the pipe or (2) act like those fluids which require high flow rates to produce the turbulence necessary to suspend and carry the debris from the pipe. Further, it is not uncommon for the fluids flowing through the pipeline to react with the gel forming the pig to dilute and/or cause disintegration of the pig before it reaches its destination and completes the desired cleaning of the pipeline.

As mentioned above, several different types of actual compositions have been used or proposed for forming the known gelled, cleaning pigs. Such compositions include (1) aqueous gels such as aqueous, cross-linked gelled galactomannan gum or derivates thereof (see U.S. Pat. No. 4,543,131); (2) a monpolar, liquid, organic solvent combined with a gelling mixture of alkyl oleyl phosphate and an alkali metal aluminate (see U.S. Pat. No. 4,473,408); (3) Bingham plastic pigs formed from (a) mineral oil and organo-modified smectite with powered coal, or (b) water and zanthan gum which may be cross-linked with a multivalent metal (see U.S. Pat. Nos. 4,216,026 and 4,416,703); and (4) a variety of other compositions, e.g., see the background discussions in each of the above-identified patents.

While a mechanical pig "launcher" and "catcher" are not needed to use a gelled, cleaning pig of the type described above, such launchers and catchers are still required in most, if not all, known cleaning operations using such pigs. This requirement results from the fact that in such operations a mechanical scraper still must be used to "push" the gelled pig through the line since the gelled pig alone does not possess the consistency or integrity required to maintain the gelled pig as a unitary mass as it is pushed by the fluids in the pipeline. That is, the gelled pig is likely to break up if pushed through the line by the flowing fluids thereby allowing debris to easily bypass the pig.

SUMMARY OF THE INVENTION

The present invention provides a method for scraping and cleaning tubulars and a gelled pig for use in said method. The gelled pig has a body comprised of gelled gelatin which has a firm, hardened layer or skin on its outer surface. The pig is molded in a size which is sufficient for the periphery of the body to contact the interior wall of a tubular to be cleaned when the pig is inserted and passed through the tubular.

More specifically, the cleaning, gelled pig of the present invention is comprised of a body formed of technical "gelatin" which has been hardened about its outer surface to form a firm, hardened layer or skin thereon. "Gelatin" refers only to the highly-branched, high molecular weight polypeptides derived from collagen.

The present gelled, cleaning pig is formed by mixing technical gelatin (i.e. gelatin derived from collagen) with a liquid, e.g. water, which has been heated to about 170° F. or above. The gelatin-hot liquid mixture is poured into an appropriate mold where it is allowed to cool to ambient temperature (e.g. room temperature) to thereby form a gelatin pig in basically in the shape of the mold which has the dimensions necessary to form a pig having a size sufficient for the periphery of the pig to contact the interior wall of the pipe which is to be cleaned by the that particular pig.

After removing the pig from the mold, the outer surface of the gelled gelatin is hardened to form a firm outer layer or skin on the pig. This can be done by merely exposing the outer surface of the gelatin pig to the atmosphere (i.e. air) for a period of time sufficient to form by dehyration a hardened, firm layer having a desired thickness (e.g. at least about ¼ inch). This hardened layer can also be formed by chemical cross-linking by applying a hardener, e.g. aldehyde, to the outer surface of the body.

In operation, a cleaning, gelled gelatin pig having a hardened outer layer thereon is formed and then inserted into the pipeline to be cleaned. The fluids flowing through the pipeline forces the pig therethrough. The hardened outer layer of the gelatin pig contacts the pipewall and "scraps" scale therefrom as the body of the pig pushes the scale and other debris ahead in the line. The present gelled gelatin cleaning pig does not require the use of a mechanical scraper in conjunction therewith thereby eliminating the need for any mechanical pig launchers in the pipeline. Further, since the gelatin pig is bio-degradable, no pig catcher is required.

To accelerate the bio-degradation of the pig, especially when said pig has been treated with a hardener such as an aldehyde, a bio-reactive agent, e.g. yeast, may be added to the gelatin-liquid mix before it is cooled in the mold.

BEST KNOWN MODE FOR CARRYING OUT THE INVENTION

In accordance with the present invention, a method and gelled pig for use in the method is provided for scraping and cleaning tubulars. The gelled pig has a body comprised of gelled gelatin which has a firm, hardened layer or skin on its outer surface. The pig is molded in a size which is sufficient for the periphery of the body to contact the interior wall of a tubular to be cleaned when the pig is inserted in and passes through the tubular. As used herein, "tubular" is intended to include any pipe or conduit through which fluids (i.e. liquids and gases) are flowed. While the present invention will be described primarily in relation to a substantially horizontal pipeline which carries crude oil, natural gas, and/or like hydrocarbon products, it can also be used for scraping and cleaning substantially vertical, inclined, and/or horizontal tubulars such as well casings and tubings.

In the present invention, the cleaning, gelled pig is a semi-solid, gelled plug or "pig" which is comprised of a body formed of common "gelatin" which has been hardened about its outer surface to form a firm, hardened layer or skin thereon. This layer contacts the interior wall of the pipeline as the pig passes therethrough to remove scale or the like therefrom as the body of the pig pushes the scale and other debris ahead through the line. Gelatin is a material which is capable of recovering from large deformations quickly and forcibly which allows the pig to easily negotiate bends, constrictions, and the like in the pipeline and has been used to form gelled pigs for treating tubulars to inhibit corrosion, reduce drag, etc.; see co-pending U.S. patent application No. 07/683,164, filed Apr. 10, 1991, and commonly assigned herewith.

As is well known and as used herein, "gelatin(s)" is a specific term of art which refers only to highly-branched, high molecular weight polypeptides derived from collagen which, in turn, is the primary protein component of animal connective tissue (e.g. bones, skin, hides, tendons, etc.). Gelatin—sometimes specifically referred to as "technical or common gelatin" and commonly used in foods (highly refined), glues (lesser refined), photographic and other products—does not exist in nature but is a hydrolysis product obtained by hot water extraction from the collageous raw material after it has been processed with acid, alkaline, or lime. The viscosity of aqueous gelatin solutions increases with increasing concentrations and decreasing temperatures. For a more complete description and discussion of gelatin, its compositions and properties, see ENCYCLOPEDIA OF CHEMICAL TECHNOLOGY, Kirk-Othmer, 3rd Edition, Vol. 11, J. Wiley & Sons, N.Y., pps. 711 et sec.

In formulating a pig in accordance with the present invention, technical gelatin (i.e. gelatin derived from collagen) is mixed with a liquid and heated. Technical gelatin will form a solution with almost any liquid except raw, uncooked pineapple juice, and the hardness (i.e. firmness) of a gelled mass of gelatin is primarily dependent on the amount of gelatin used and is relatively independent of the liquid used to form the gelatin mixture. Preferably, in the present inveniton, the gelatin is mixed with water which has been heated to about 170° F. or above to form a gelatin mixture. If mixed in a frigid environment, an anti-freeze material, e.g. methanol, may be added to keep the water from freezing while the gelatin is gelling. The actual amount or concentration of technical gelatin in any particular gelatin mixture can vary over a wide range (e.g. from about 2% to about 90%) depending on the particular cleaning operation to be carried out.

The gelatin-hot liquid mixture is poured into an appropriate mold where it is allowed to cool to ambient temperature (e.g. room temperature) to thereby form a gelatin pig in basically in the shape of the mold, e.g. an elongated cylinder. Of course the mold will have the desired dimensions necessary to produce a pig which will have a size sufficient for the periphery of the pig to contact the interior wall of the pipe in which the pig is to be used. In practice, the diameter of the gelled, gelatin pig may actually be slightly larger or smaller than the diameter of the pipeline which is to be scraped and cleaned.

If the diameter of the pig is larger, due to the compliancy of the gelatin, the pig will be compressed when inserted into the pipeline thereby providing an additional outward bias which aids in maintaining the periphery of the pig against the wall of the pipeline as the pig moves therethrough. The pressure from the fluids being pushed ahead of the pig will act on the leading face of the pig while the pressure of the fluids pushing the pig will act on its rear face. These opposite acting pressures radially-compress the pig along its longitudinal axis to continuously force the periphery of gelatin pig into contact with the pipewall at all times, even if material should wear off the pig. This is true regardless whether the diameter of the pig is smaller, larger, or approximately the same as the diameter of the pipeline so that the pig will continue to maintain contact with the wall during the entire cleaning operation.

After removing the pig from the mold, the outer surface of the gelled gelatin is hardened to form a firm outer layer or skin on the pig. This can be done by merely exposing the outer surface of the gelatin pig to the atmosphere (i.e. air) for a period of time sufficient to form a hardened, firm layer to a desired thickness or depth into the body (e.g. at least about ¼ inch). Exposure to the air "dehydrates" the outer, exposed portions of the gelatin body much in the same way as cheese hardens when exposed to air so that the longer the pig is exposed to the air, the thicker the hardened layer becomes.

While the hardened layer on the gelatin body of the pig will contact the internal pipe wall as the pig moves through the pipeline to provide a scraping action for removing scale from the pipewall, it is not so firm as to substantially interfer with the compliancy of the pig which is provided by the unexposed gelatin forming the inner body of pig.

In situations where time is of the essence (i.e. time is limited as to exposing the pig to the air) or the gelatin pig is to be used in extremely high temperature lines, e.g. 200° F. or above, the outer surface of the body of gelatin may be hardened by applying a hardener to the outer surface of the body, e.g. "painting" the outer surface of the pig with an hardener. Examples of hardeners which can be used (e.g. aldehydes such as formaldehydes) are the same as those used to harden gelatin for photography applications, see THE THEORY OF THE PHOTOGRAPHIC PROCESS, Third Edition, The Macmillan Co., N.Y. Chapter 3, pps. 45–60. Again, the thickness of the hardened layer of gelatin can be controlled by the amount of hardener applied to the outer surface of the gelled pig.

In operation, a cleaning, gelled gelatin pig having a hardened outer layer thereon is formed as set forth above. The pig is then inserted into the pipeline and is moved therethrough by the fluids flowing in the pipeline. The hardened outer layer of the gelatin pig, due to the compliancy of the gelled gelatin body of the pig, remains in contact with the pipewall as the pig moves through the line and "scraps" scale therefrom as the pig pushes the scale and debris ahead in the line. Even if some of the hardened layer abrades as it scraps against the pipewall, the roughened layer that remains still functions as before.

By using the gelled gelatin cleaning pig of the present invention, no mechanical scraper is required thereby eliminating the need for expensive mechanical pig launchers in the pipeline. Further, since the gelatin pig will bio-degrade after a passage of time, there is no need to install a mechanical pig catcher in the pipeline since the bio-degraded and disintegrated gelatin merely flows out of the line with the pipeline fluids and debris at the end of the of pipeline.

To make sure that a gelatin cleaning pig will be sufficiently bio-degraded and disintegrated upon reaching its final destination, especially when said pig has been treated with a hardener such as an aldehyde, a bio-reactive agent may be added to the gelatin-liquid mix before it is cooled in the mold to accelerate the rate of bio-degradation. The bio-reactive agent may be selected from certain enzymes, e.g. peptic enzymes, or from certain fungi, e.g. yeast. The following are the results of a test which show the bio-degradation effects that respective quantities of common baker's yeast (Fleischmann Dry Super Yeast) have on a particular gelatin composition:

| Sample No. | Water | Gelatin | Yeast |
|---|---|---|---|
| 1 | 95 grams | 15 grams | 0.0 grams |
| 2 | 95 grams | 15 grams | 4.0 grams |
| 3 | 95 grams | 15 grams | 0.4 grams |
| 4 | 95 grams | 15 grams | 0.04 grams |

The samples were made up and allowed to gel and each was placed in a separate 500 ml plastic container with a loose fitting cover. Each container was then placed in an oven at a constant 83° F. and left for approximately 76.5 hours, after which the following observations were made:

| | |
|---|---|
| Sample No. 1 | No apparent change in hardness, slight odor. |
| Sample No. 2 | Almost completely disintegrated, fibrous mold, yeasty odor. |
| Sample No. 3 | Somewhat softened, yeasty odor. |
| Sample No. 4 | Same as No. 1 except yeasty odor. |

It can be seen from the above that the amount of bio-reactive agent can be varied in relation to the size of a particular pig and the time estimated for the pig to carry out its cleaning function in a particular pipeline so that the pig will not substantially bio-degrade until after it reaches its destination.

What is claimed is:

1. A method for cleaning a tubular comprising:

passing a gelled, cleaning pig through said tubular wherein said pig contacts the interior wall of said tubular to remove scale and push said scale and other debris ahead through said tubular, said cleaning pig comprising:

a body of gelled gelatin having an hardened layer on its outer surface and having a size sufficient for the periphery of said body to contact the interior wall of said tubular when said pig is positioned in and passes through said tubular; wherein said body of gelled gelatin is formed from a mixture of (a) common gelatin of the type derived from collagen and (2) a heated liquid which is then allowed to cool to ambient temperature.

2. The method of claim 1 wherein said heated liquid is at a temperature of about 170° F. and said ambient temperature is less than about 100° F.

3. The method of claim 2 wherein said heated liquid comprises:

water

4. The method of claim 1 wherein said pig is formed by allowing the gelatin-heated liquid mixture to cool in a mold having the dimensions necessary to form a pig to be used in a particular tubular.

5. The method of claim 1 wherein said hardened outer layer is at least about ¼ inch thick.

6. The method of claim 1 wherein said hardened outer layer is formed by exposing said body of gelatin to the atmosphere after said gelatin has gelled for a time sufficient to form a hardened layer of a desired thickness.

7. The method of claim 1 wherein said hardened outer layer is formed by applying a hardener to said outer surface of said gelatin body after said gelatin has gelled.

8. The method of claim 7 wherein said hardener comprises:

an aldehyde.

9. The method of claim 1 including:

a bio-reactive agent in said body of gelled gelatin to react with said gelatin and accelerate bio-degradation of said gelatin.

10. The method of claim 9 wherein said bio-reactive agent comprises:

yeast.

* * * * *